US008561824B2

(12) United States Patent
Nakayama et al.

(10) Patent No.: US 8,561,824 B2
(45) Date of Patent: Oct. 22, 2013

(54) ASSEMBLY BOX AND PLATE MATERIAL CONNECTING STRUCTURE

(75) Inventors: Kazuhisa Nakayama, Osaka (JP); Fumio Nakayama, Yokohama (JP); Shinji Ishii, Kouza-gun (JP)

(73) Assignee: Nakayama Industry Co., Ltd, Osaka (JP)

( * ) Notice: Subject to any disclaimer, the term of this patent is extended or adjusted under 35 U.S.C. 154(b) by 939 days.

(21) Appl. No.: 12/067,580

(22) PCT Filed: Sep. 21, 2006

(86) PCT No.: PCT/JP2006/318787

§ 371 (c)(1),
(2), (4) Date: Mar. 20, 2008

(87) PCT Pub. No.: WO2007/034901

PCT Pub. Date: Mar. 29, 2007

(65) Prior Publication Data

US 2009/0152264 A1 Jun. 18, 2009

(30) Foreign Application Priority Data

Sep. 21, 2005 (JP) ..... 2005-273229

(51) Int. Cl.
*B65D 6/00* (2006.01)
*B65D 8/14* (2006.01)

(52) U.S. Cl.
USPC ..... 220/4.29

(58) Field of Classification Search
USPC ..... 220/4.29, 4.32, 4.33, 4.34, 6
See application file for complete search history.

(56) References Cited

U.S. PATENT DOCUMENTS 865,538 A * 9/1907 Smith ..... 220/4.32
1,159,229 A * 11/1915 Keith ..... 217/12 R (Continued)

FOREIGN PATENT DOCUMENTS

JP 3-120490 U 12/1991
JP 4-214738 A 8/1992

(Continued)

OTHER PUBLICATIONS

International Search Report for PCT/JP2006/318787 mailed Dec. 26, 2006.

(Continued)

*Primary Examiner* — Anthony Stashick
*Assistant Examiner* — Brett Edwards
(74) *Attorney, Agent, or Firm* — Roberts Mlotkowski Safran & Cole, P.C.

(57) ABSTRACT

[Objective] To provide a box that allows easy tasks involved in assembling and disassembling and a novel plate material connecting structure adapted thereto.

[Means to solve the problem] An assembly box comprises: a frame 1 (or 10) that is rectangular as seen from the top and whose four sides are formed from plate materials 11*a* and the like which are square as seen from the front; and a base 2 that has a placement plane 2*a* for the frame 1 and guides 21 and the like for supporting the plate materials constituting the frame 1 on the placement plane 2*a*. A first connecting part 111 and a second connecting part 122 (or a first connecting part 121 and a second connecting part 112) are positioned at corners of the frame 1 and have each a detachable locking mechanism. The locking mechanism is configured to separate two connected plate materials by inclining either one of the plate materials at a predetermined or larger angle with reference to the plate material connecting part.

6 Claims, 14 Drawing Sheets

(56) References Cited

U.S. PATENT DOCUMENTS

| | | | | | |
|---|---|---|---|---|---|
| 3,635,368 | A | * | 1/1972 | Winsor | 220/6 |
| 3,655,087 | A | * | 4/1972 | Luisada | 220/1.5 |
| 3,809,278 | A | * | 5/1974 | Csumrik | 220/4.33 |
| 3,831,799 | A | | 8/1974 | Nutt | |
| 3,999,676 | A | * | 12/1976 | Trebilcock et al. | 220/6 |
| 4,020,967 | A | * | 5/1977 | Hammond et al. | 220/6 |
| 4,057,165 | A | * | 11/1977 | Kardell | 220/6 |
| 4,148,407 | A | * | 4/1979 | Sinclair | 220/7 |
| 4,807,774 | A | * | 2/1989 | Karpisek | 220/6 |
| 5,265,750 | A | * | 11/1993 | Whiteley et al. | 220/4.31 |
| 5,395,002 | A | * | 3/1995 | Adler | 220/4.28 |
| 5,588,549 | A | * | 12/1996 | Furtner | 220/7 |
| 5,597,084 | A | * | 1/1997 | Parasin | 220/4.28 |
| 5,680,948 | A | * | 10/1997 | Schmidt et al. | 220/7 |
| 6,107,575 | A | * | 8/2000 | Miranda | 174/101 |
| 6,446,824 | B1 | * | 9/2002 | Sluiter | 220/6 |
| 2004/0155037 | A1 | * | 8/2004 | Hoogland | 220/6 |
| 2009/0152264 | A1 | * | 6/2009 | Nakayama et al. | 220/4.32 |

FOREIGN PATENT DOCUMENTS

| | | | |
|---|---|---|---|
| JP | 6-211240 | A | 8/1994 |
| JP | 8-119268 | A | 5/1996 |
| JP | 2001-139028 | A | 5/2001 |
| JP | 2002068184 | A | 3/2002 |
| JP | 2002145262 | A | 5/2002 |
| JP | 2002-255165 | A | 9/2002 |
| JP | 2003-300529 | A | 10/2003 |

OTHER PUBLICATIONS

Office Action dated Oct. 18, 2011, in corresponding Japanese Patent Application No. 2005-273229, and partial English translation.

Office Action dated Jun. 6, 2011 in corresponding Japanese Patent Application No. 2005-273229.

* cited by examiner

ASSEMBLY BOX AND PLATE MATERIAL CONNECTING STRUCTURE

TECHNICAL FIELD

The present invention relates to a box that can be freely assembled and disassembled and a plate material connecting structure thereof. More specifically, the present invention relates to a box that can be disassembled into individual plate materials simply by inclining the plate materials at a predetermined or larger angle and that is devised so as to maintain a box shape reliably when assembled, and to a plate material connecting structure for attaining the same.

BACKGROUND ART

Currently, physical distribution is being carried out over longer distances and on a more international scale than before, where transportation of larger-sized and higher-precision articles is on the rise. As is well known, cases and containers storing articles to be transported are used in various distribution processes. Typically used are paper cardboard boxes, but in recent years, there have been increased occasions when cases or containers made from plate materials such as synthetic resin cardboard are employed.

Synthetic resin cases and containers are popularized mainly because they can be repeatedly used to provide a cost advantage and reduce environmental burdens, and can be easily subjected to technical development in pursuit of improved durability and weather-resistance, higher strength, material recycling, antistatic and antimicrobial properties, and so on.

At present, there are proposed various transport cases and containers of this type that can be folded to make them less bulky in repeatedly using them after transportation (that is, in using them as returnable boxes) (refer to Patent Documents 1 and 2). In addition, there is proposed an assembly container that can be separated into plate materials and stacked on a pallet (Patent Document 3).

Patent Document 1: Japanese Utility Model Publication No. 4-214738

Patent Document 2: Japanese Unexamined Patent Publication No. 6-211240

Patent Document 2: Japanese Unexamined Patent Publication No. 2002-255165

DISCLOSURE OF THE INVENTION

Problem to be Solved by the Invention

In the future, in a field of an assembly box as stated above, there will be increased demand for a box that suits transportation of various articles in functional aspects and has a simple structure so that it can be assembled and disassembled without effort.

Thus, a principal object of the present invention is to provide a box that allows easy tasks involved in assembling and disassembling and a novel plate material connecting structure adapted thereto.

Means to Solve the Problem

First, an assembly box provided by the present invention comprises: a frame that is rectangular as seen from the top and whose four sides are formed from plate materials which are square as seen from the front; and a base that has a placement plane for the frame and guides for supporting the plate materials constituting the frame on the placement plane. Plate material connecting parts are positioned at corners of the frame and have each a detachable locking mechanism. The locking mechanism is configured to separate two connected plate materials by inclining either one of the plate materials at a predetermined or larger angle, preferably 5° or more with reference to the plate material connecting part. When a minimum inclination angle required for plate separation is less than 5°, the frame becomes excessively prone to disassemble, which is not preferred in keeping a shape of the frame.

In addition, an assembly box of the present invention is devised such that disassembled plate materials (four, for example) can be stacked on the placement plane of the base and be closed by a predetermined cover member capable of being fixed to the base. Such a configuration is not so bulky, and thus increases transport efficiency (space efficiency during transport) when returned to an article storage site.

There are no particular limits on material, size, thickness or structure of plate materials used for an assembly box of the present invention. In addition, the assembly box includes wide-ranging concepts of cases and containers and is particularly useful as a container for transporting an article, and also the base can be freely utilized as a forklift pallet.

Next, the present invention provides a plate material connecting structure. The plate material connecting structure for locking and connecting ends of two plate materials in a detachable manner, comprises: a first connecting part along an end of one plate material; and a second connecting part along an end of the other plate material and capable of being locked into the first connecting part. The first connecting part includes a forefront portion and a concave groove formed at a position with a predetermined distance from an end of the forefront portion. The second connecting part includes a space capable of embracing the forefront portion and an L-shaped pawl fitted into the concave groove. Two connected plate materials can be separated by inclining either one of the plate materials at a predetermined or larger angle with respect to the connecting part.

The first and second connecting parts may be integrated into the plate materials. Alternatively, these mechanisms may be formed separately from the plate materials and be attached to ends of the plate materials in respective appropriate manners.

Effect of the Invention

According to an assembly box and a plate material connecting structure thereof in the present invention, the box can be easily disassembled into individual plate materials merely by inclining the plate materials at a predetermined or larger angle, also the plate materials can be readily connected, and further the box can be reliably kept in shape when assembled.

BEST MODES FOR CARRYING OUT OF THE INVENTION

Preferred embodiments of the present invention will be described below with reference to the attached drawings. The embodiments discussed below merely represent typical examples and do not cause the scope of the present invention to be construed in a limited sense.

First, FIG. 1 is a plan view as seen from the top (top view) of one embodiment of a frame constituting an assembly box in the present invention.

The top-view square frame indicated with reference numeral 1 in FIG. 1 serves a four-side wall part constituting a box and is composed of total four plate materials 11*a*, 11*b*,

12*a,* and 12*b* (refer to FIG. 1). It is noted that there is a space S inside the frame 1, which is designed to have a capacity for storing an article to be transported (refer to FIG. 1).

The size, thickness, material, structure and the like for the plate materials 11*a,* 11*b,* 12*a* and 12*b* usable in the present invention are not particularly limited and can be set in accordance with the intended use. For example, a wide variety of materials including wood, metal, and synthetic resin can be used, and a wide variety of structures including solid structure, foam structure, porous structure, inner-core structure (rib structure) can be used. An inner-core structure of cardboard (not shown) may be vertically arranged so that the frame 1 is increased in strength against an upward load.

One pair of opposing plate materials 11*a* and 11*b* in the frame 1 have each one end with a first connecting part 111 and the other end with a second connecting part 112 locked into the first connecting part 111. A longitudinal plate material 12*a* constituting the frame 1 has at both ends a first connecting part 121 (which is the same in shape as the first connecting part 111), and a plate material 12*b* has at both ends a second connecting part 122 (which is the same in shape as the second connecting part 112) (refer to FIG. 1).

Description will be given as to a mechanism in a connecting section at a corner indicated with reference code X in FIG. 1, with reference to FIG. 2 as a magnified view of the connecting section. In the connecting section X, the first connecting part 111 provided at one end of the plate material 11*a* and the second connecting part 122 provided at one end of the plate material 12*b* are connected in a locking state.

The first connecting part 111 comprises a forefront portion 1111 in a predetermined shape, and a concave groove 1112 formed at an outer side with a predetermined distance from an end 1111*a* of the forefront portion 1111. The second connecting part 122 comprises a space 1221 capable of embracing the forefront portion 1111, and an L-shaped pawl 1222 having an end bending portion 1222*a* fitted into the concave groove 1112.

FIG. 2 (I) illustrates a state where the plate materials 11*a* and 12*b* are orthogonal to each other and the first and second connecting parts 111 and 122 are locked and fixed together. Meanwhile, FIG. 2 (II) illustrates a state where the plate material 11*a* with the first connecting part 111 is inclined at an angle α toward the space S (in a direction shown by an arrow A in FIG. 2). In this inclined state, the end bending portion 1222*a* of the second connecting part 122 is off the concave groove 1112 of the first connecting part 111 to release the lock (refer to FIG. 2 (II)). Accordingly, the plate material 11*a* can be easily separated from the plate material 12*b* by sliding the plate material 11*a* in a direction shown by an arrow B in FIG. 2.

Next, description will be given as to a mechanism in a connecting section at a corner indicated with reference code Y in FIG. 1, with reference to FIG. 3 as a magnified view of the connecting section. In the connecting section Y, the first connecting part 121 at one end of the plate material 12*a* and the second connecting part 112 at one end of the plate material 11*b* are connected in a locking state.

The first connecting part 121 comprises a forefront portion 1211 in a predetermined shape and a concave groove 1212 at an outer side with a predetermined distance from an end 1211*a* of the forefront 1211. The second connecting part 112 comprises a space 1121 capable of embracing the forefront portion 1211 and an L-shaped pawl 1122 having an end bending portion 1122*a* fitted into the concave groove 1212.

FIG. 3 (I) illustrates a state where the plate materials 12*a* and 11*b* are orthogonal to each other and the first and second connecting parts 121 and 112 are locked and fixed together. Meanwhile, FIG. 3 (II) illustrates a state where the plate material 11*b* with the second connecting part 112 is inclined at an angle β toward the space S (in a direction shown by an arrow C in FIG. 3). In this inclined state, the end-bending portion 1122*a* of the second connecting part 112 is off the concave groove 1212 of the first connecting part 121 to release the lock (refer to FIG. 3 (II)). Accordingly, the plate material 11*b* can be easily separated from the plate material 12*a* by sliding the plate material 11*b* in a direction shown by an arrow D in FIG. 3, for example.

The inclination angle α (of the plate material 11*a*) shown in FIG. 2 and the inclination angle β (of the plate material 11*b*) shown in FIG. 3 may be set such that the end bending portions 1222*a* (FIG. 2) and 1122*a* (FIG. 3) of the second connecting part come off from the concave grooves 1112 and 1212, respectively, to release the lock when these angles become 5° or more, more preferably 6° or more. When the minimum inclination angles α and β required for plate separation are less than 5°, the frame 1 becomes excessively prone to disassemble, which is not preferred in keeping a shape of the frame.

The first connecting parts 111 and 121 and the second connecting parts 112 and 122 may be integrated into plate materials. Alternatively, if integral formation is difficult due to properties of the plate materials, an embodiment as shown in FIG. 4 may be employed instead. In the embodiment of FIG. 4, synthetic resin or metal connecting fixtures 13 and 14 formed separately from the plate materials, are fitted into an end $\mathbf{11}a_1$ of the plate material 11*a* and an end $\mathbf{12}b_1$ of the plate material 12*b* and are fixed with a fastener 15 such as a bolt. A method for fixing the connecting fixtures 13 and 14 is not particularly limited and can be selected as appropriate.

The connecting fixture 13 is configured to be the same in form as the first connecting parts 111 and 121, and the connecting fixture 14 is configured to be the same in form as the second connecting parts 112 and 122. Therefore, the connecting fixtures 13 and 14 are identical in locking mechanism and thus description on the locking mechanism is omitted.

Subsequently, FIG. 5 is a top plan view showing one example of a modified embodiment of the frame 1. Plate material connecting structures at total four corners of a frame 10 shown in FIG. 5 are the same as those in the frame 1 (description is omitted). The frame 10 differs from the frame 1 in employing: a plate material 11*c* on which bar-shaped projections 113 and 113 are disposed in the proximity of a lower end with a predetermined spacing between the projections; and a plate material 11*d* with same projections 114 and 114. The longitudinal plate materials 12*a* and 12*b* of the frame 10 are the same as those of the frame 1.

FIG. 6 is a view showing one example of an embodiment of a base for placement of the frame 1 or 10. In particular, a base indicated with reference numeral 2 in FIG. 6 is adapted to the frame 10 (refer to FIG. 5). Description will be provided below with use of the frame 10.

An upper surface 2*a* of the base 2 serves as a placement plane for the frame 10. When the frame 10 is erected on the placement plane 2*a,* the placement plane 2*a* serves as a bottom surface of the box. If the frame 10 is merely placed on the placement plane 2*a,* positioning is not properly carried out and also a shape of the frame 10 is difficult to keep when an external force is applied.

Accordingly, guides 21, 22, 23 and 24 of predetermined lengths with an L shape at vertical section are arranged on the base 2 so as to surround the placement plane 2*a* on four sides (refer to FIG. 6). The guides 21 to 24 are all fixed to the placement plane 2*a*. Fixing means for the guides 21 to 24 are not particularly limited and materials usable for the fixing means include wood, metal, synthetic resin and the like and are not particularly limited in a narrow sense.

The guides 21 to 24 support the total four plate materials 11*c*, 11*d*, 12*a* and 12*b* constituting the frame 10 at respective lower ends (the ends at the placement plane 2*a* side) to contribute to keeping of the frame form. Rectangular holes 25 and 25 are formed in side surfaces of the base 2 and used to insert a fork of a forklift truck into the base 2 as a pallet.

Two holes 211 and 211 are formed with a predetermined space between them in an erect plate 21*a* of the guide 21. Similar holes 221 and 221 are formed in an erect plate 22*a* of the guide 22 opposing to the guide 21. The projections 113 and 113 at a lower end of the plate material 11*c* (refer to FIG. 5) are inserted into the holes 211 and 211 of the guide 21, and the projections 114 and 114 at a lower end of the plate material 11*d* (refer to FIG. 5) are inserted into the holes 221 and 221 of the guide 22.

FIG. 7 is a partial perspective view of the guide 22 and its surroundings when the plate material 11*d* alone is provided inside the guide 22 of the base 2. As shown in FIG. 7, the plate material 11*d* is erected on the placement plane 2*a* of the base 2. A lower end of an outer surface F of the plate material 11*d* is in contact with an inner surface of the erect plate 22*a* of the guide 22 (refer to FIG. 7). Accordingly, the plate material 11*d* is supported such that its outward shift is prevented. Such a configuration applies to the opposing guide 21 and plate material 11*c* (refer to FIG. 5 and FIG. 6), and also applies to the other plate materials 12*a* and 12*b*.

Next, FIG. 8 is a view showing a disassembly process of the frame 10 in five steps (*a* to *e*), with top plan views of the frame 10 on the base 2. FIG. 9 is a perspective view showing the same disassembly process in five steps (*a* to *e*). It is to be noted that the disassembly steps in FIGS. 8 and 9 are all in correspondence with each other. The guides 21 to 24 in FIG. 8 are indicated by phantom lines for visual convenience. The disassembly process will be described below in sequence with reference to both FIGS. 8 and 9.

(*a*) Step

In this step, the longitudinally located plate material 12*b* is pulled out upward (refer to an arrow E in FIG. 9 (*a*)). It is to be noted that the connecting parts in the plate material 12*b* and plate materials 11*c* and 11*d* merely constitute the locking mechanism as stated above, and thus the plate material 12*b* can freely slide in a vertical direction with respect to the plate materials 11*c* and 11*d*.

(*b*) Step

FIGS. 8 (*b*) and 9 (*b*) illustrate a state where, after the plate material 12*b* has been pulled out from the frame 10, the other three plate materials 11*c*, 11*d*, and 12*a* forming a U-shaped as seen from the top remain connected and erected. In this configuration that is open at one side, it is possible to take an article in and out between an opening 26 (refer to FIG. 9) and the space S.

In this (*b*) form, both ends of the plate materials 11*c* and 11*d* at an entry of the opening 26 (the ends to be connected to the plate material 12*b*) constitute the first connecting parts 111 and 111, and thus have no projecting obstacles with respect to the space S. This allows an article to be smoothly taken in and out. If the ends of the plate materials 11*c* and 11*d* constitute the second connecting parts 112, the plate materials 11*c* and 11*d* would each have the L-shaped pawl 1122 (refer to FIG. 7, for example) projected toward the space S, which may impede taking in and out of an article. Therefore, in such a configuration with the frame 10, it is preferred that the plate material 12*b* be the first to be pulled out, not the plate material 12*a*.

(*c*) Step

In this step, the transversely located plate material 11*d* is inclined toward the space S at a predetermined or larger angle (refer to an arrow G in FIGS. 8 and 9). In this step, the projections 114 and 114 come off from the holes 221 and 221 of the guide 22. Sequentially, the plate material 11*d* is pulled out upward and separated from the plate material 12*a*.

(*d*) Step

Then, the other transversely located plate material 11*c* is inclined toward the space S at a predetermined or larger angle (refer to an arrow H in FIGS. 8 and 9). In this step, the projections 113 and 113 (refer to FIG. 5) come off from the holes 211 and 211 of the guide 21. Sequentially, the plate material 11*c* is pulled out upward and separated from the plate material 12*a*.

(*e*) Step

FIGS. 8 (*e*) and 9 (*e*) illustrate a state where, after the plate materials 12*b*, 11*d* and 11*c* have been separated from the frame 10, the last plate material 12*a* remains erected on the placement plane 2*a* (the disassembly process is completed).

FIG. 10 is a magnified view of a part indicated with reference code Z in FIG. 8 for illustrating the foregoing (*c*) process in detail. In FIG. 10, the plate material 11*d* is inclined inward (toward the space S) at a predetermined or larger angle (5° or more, for example) with respect to the plate material 12*a*, where the projection 114 projecting from the outer surface F of the plate material 11*d* is off the hole 221 in the erect plate 22*a* of the adjacent guide 22. At the same time, the end bending portion 1122*a* of the second connecting part 112 of the plate material 11*d* is off the concave groove 1212 of the first connecting part 121 of the plate material 12*a*. In this state, the plate material 11*d* can be separated from the plate material 12*a* simply by pulling out.

FIG. 11 illustrates a state where, after all the disassembly steps have been completed, the four separated plate materials 11*c*, 11*d*, 12*a* and 12*b* are stacked on the placement plane 2*a* of the base 2 and the cover member 3 is being laid on the placement plane 2*a* from above to close the placement plane 2*a*. Accordingly, the plate materials 11*c*, 11*d*, 12*a* and 12*b* can be returned in the state of being closed by the cover member 3 to the article storage site.

Inner wall surfaces of the four walls constituting the cover member 3 are closed such that they are opposed to and in contact with outer wall surfaces of the erect plates of the guides 21 to 24 on the placement plane 2*a* of the base 2. In addition, to prevent the cover member 3 from coming off, it is preferred to provide a means for fixing the cover member 3 and the base 2, for example, a belt tightening means or the like (not shown).

Next, FIGS. 12 to 14 are views showing one example of a disassembly process with the frame 1 (refer to FIG. 1). In this disassembly process, as shown in FIG. 12 (I), first the plate materials 12*a* and 12*b* are pulled upward to a position where the plate materials 12*a* and 12*b* are mounted on upper ends of the erect plates of the guides 23 and 24. (Refer to an arrow K. It is to be noted that the plate materials 12*a* and 12*b* are not completely pulled out).

Sequentially, as shown in FIG. 12 (II), the plate materials 11*a* and 11*b* are slid in directions of arrows L and L such that the frame 1 turns into a parallelogram as seen from the top, where the pulled plate materials 12*a* and 12*b* are mounted on the guides 23 and 24, respectively.

FIG. 13 illustrates a preferred structure between plate materials and guides involved in sliding the plate materials 11*a* and 11*b*. Taking the plate material 11*b* as an example, long holes 22*b* and 22*b* are formed around right and left ends of the erect plates of the guide 22 supporting the plate material

11*b*, respectively, and bolts 16 and 16 are projected at corresponding positions on the plate material 11*b*.

The bolts 16 and 16 are inserted into large hole portions 22*c* and 22*c* formed in the long holes 22*b* and 22*b* at predetermined slide positions (refer to FIG. 13). When slid in an opposite direction, the bolts 16 and 16 are moved into narrow hole portions 22*d* and 22*d* in the long holes 22*b* and 22*b*, whereby umbrella-shaped heads 161 and 161 of the bolts 16 and 16 serve as stoppers so that the bolts 16 and 16 cannot be pulled out.

Based on the foregoing configuration, a disassembly process of the frame 1 on the base 2 will be described with reference to FIG. 14.

(*a*) step. A state shown in FIG. 14 (*a*) follows the state shown in FIG. 12 (II). More specifically, the longitudinally located plate materials 12*a* and 12*b* are already mounted on the respective guides 23 and 24, and the frame 1 takes the form of a parallelogram as seen from the top. In this state, the plate material 11*b* is inclined inward (in a direction of an arrow M in FIG. 14) and then separated.

(*b*) step. Subsequently, in (*b*) step of FIG. 14, the plate material 12*a* is inclined outward (in a direction of an arrow N in FIG. 14) and then separated.

(*c*) step. In this step, subsequent to the operation with the plate material 12*a* in the previous step, the longitudinal plate material 12*b* is inclined outward (in a direction of an arrow O in FIG. 14) and then separated.

(*d*) step. In this step, the plate material 11*a* alone remains erected on the placement surface 2*a* of the base 2.

(*e*) step. In this step, all the separated plates 11*a*, 11*b*, 12*a*, and 12*b* are gathered again on the base 2.

(*f*) step. In this step, all the plate materials 11*a*, 11*b*, 12*a*, and 12*b* are stacked on the placement plane 2*a* of the base 2. Subsequent to this step, similarly as in FIG. 11, the cover member 3 is laid from above to close the plate materials 11*a*, 11*b*, 12*a*, and 12*b* stacked on the placement plane 2*a* (refer to FIG. 11).

As foregoing, a configuration of the present invention has been described on the basis of preferred embodiments with reference to FIGS. 1 to 14. In storing and transporting an article, the cover member 3 (refer to FIG. 11) is laid on the frame 1 or 10 erecting on the base 2 so that a top, four sides and bottom of the space S (refer to FIG. 1) are closed. It is to be noted that the frame 1 or 10 and the cover member 3 can be fixed together. In one example, a fastener is provided on outer surfaces of some plate materials (at least a pair of opposing plate materials) at predetermined positions such that a belt at a position corresponding to the cover member 3 are fitted into the fastener to fix the plate materials.

Industrial Applicability

The present invention can be used as a case or container suitable for transporting or storing an article. In particular, the present invention can be used as a so-called returnable box that is delivered between an article storage site and a destination site.

DESCRIPTION OF REFERENCE NUMERALS

Figure 1:
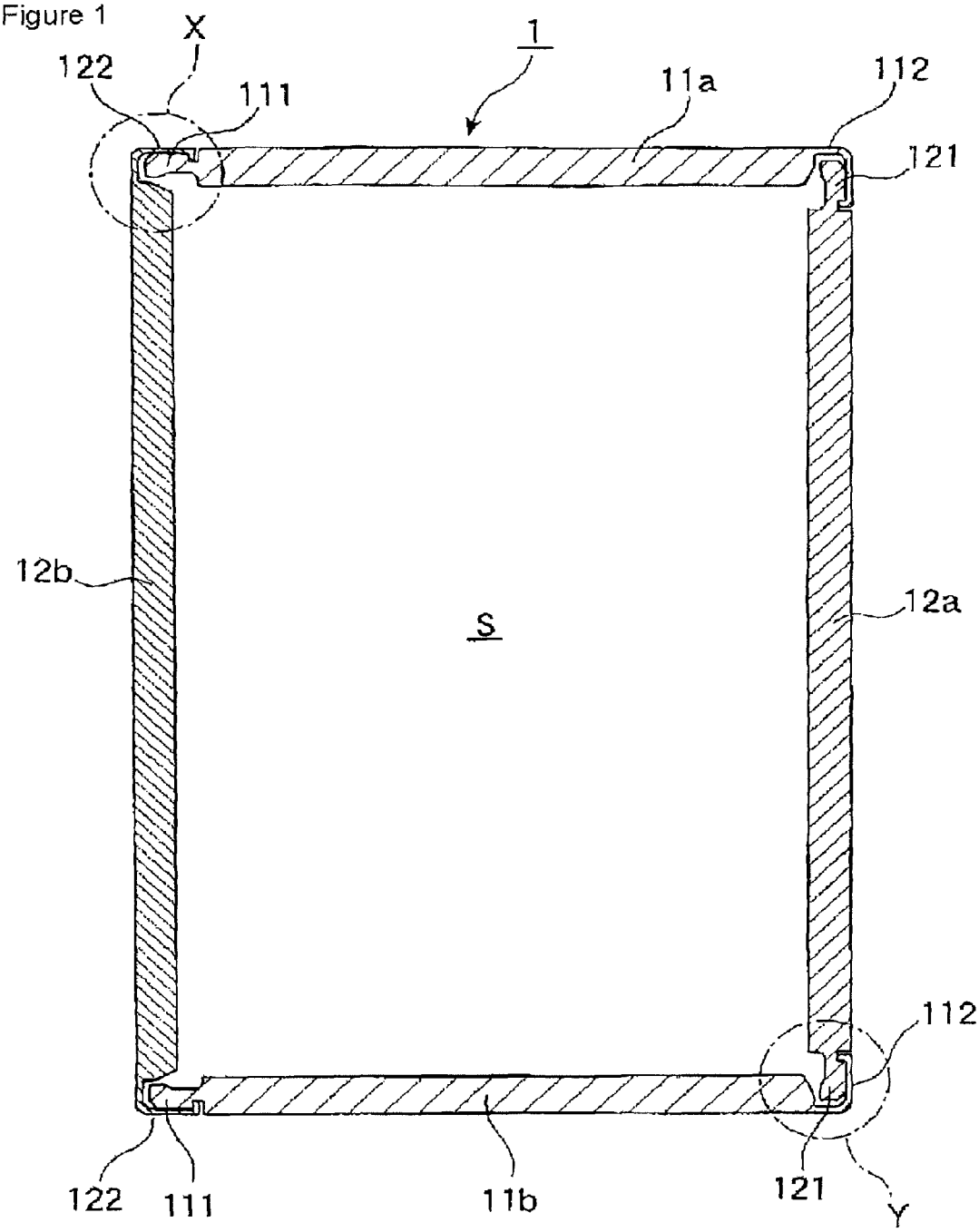
FIG. 1 is a plan view as seen from the top (top plan view) of one embodiment of a frame constituting an assembly box in the present invention.
Figure 2:
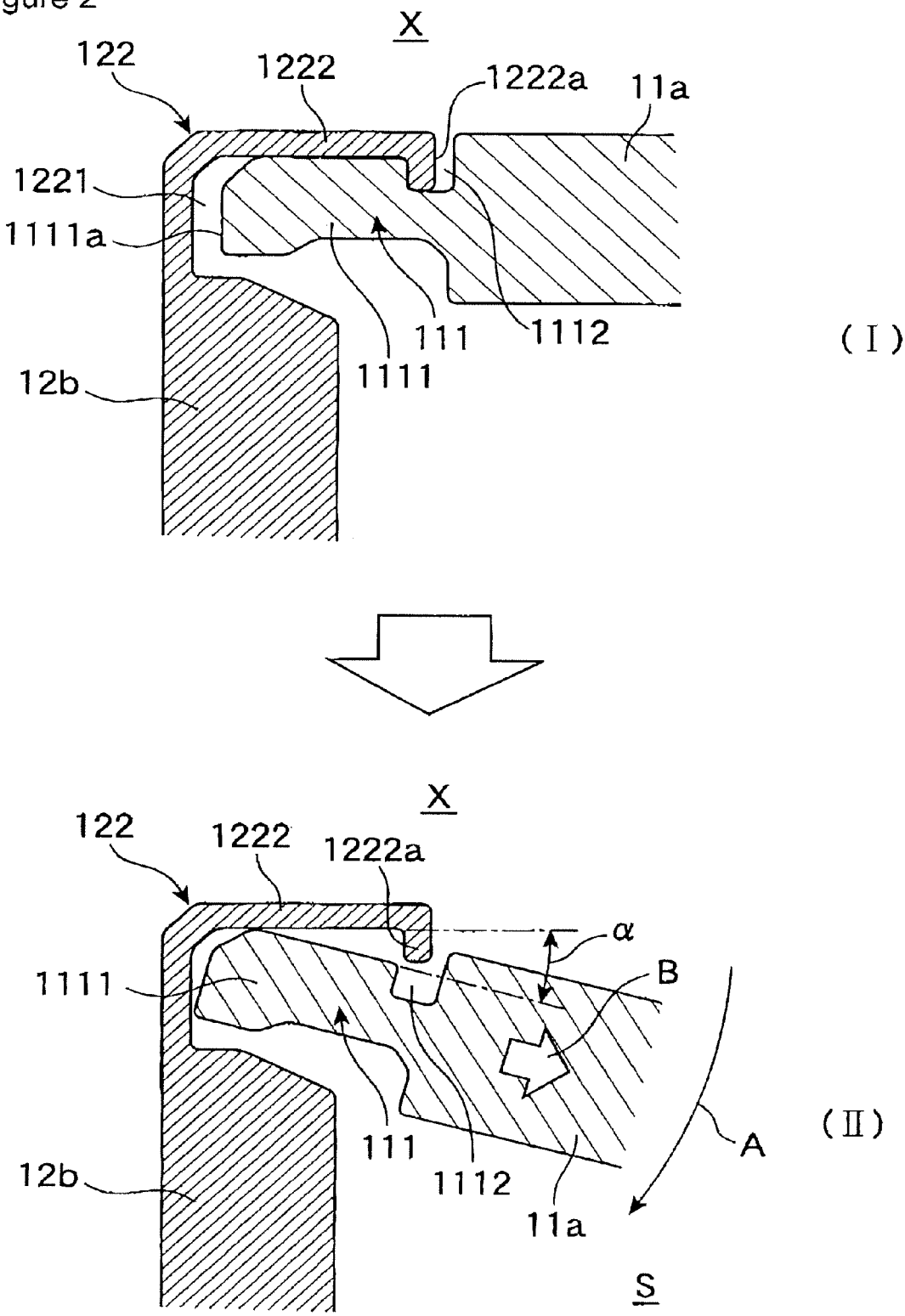
FIG. 2 is a magnified view of an X portion in FIG. 1 (showing a connecting structure)
Figure 3:
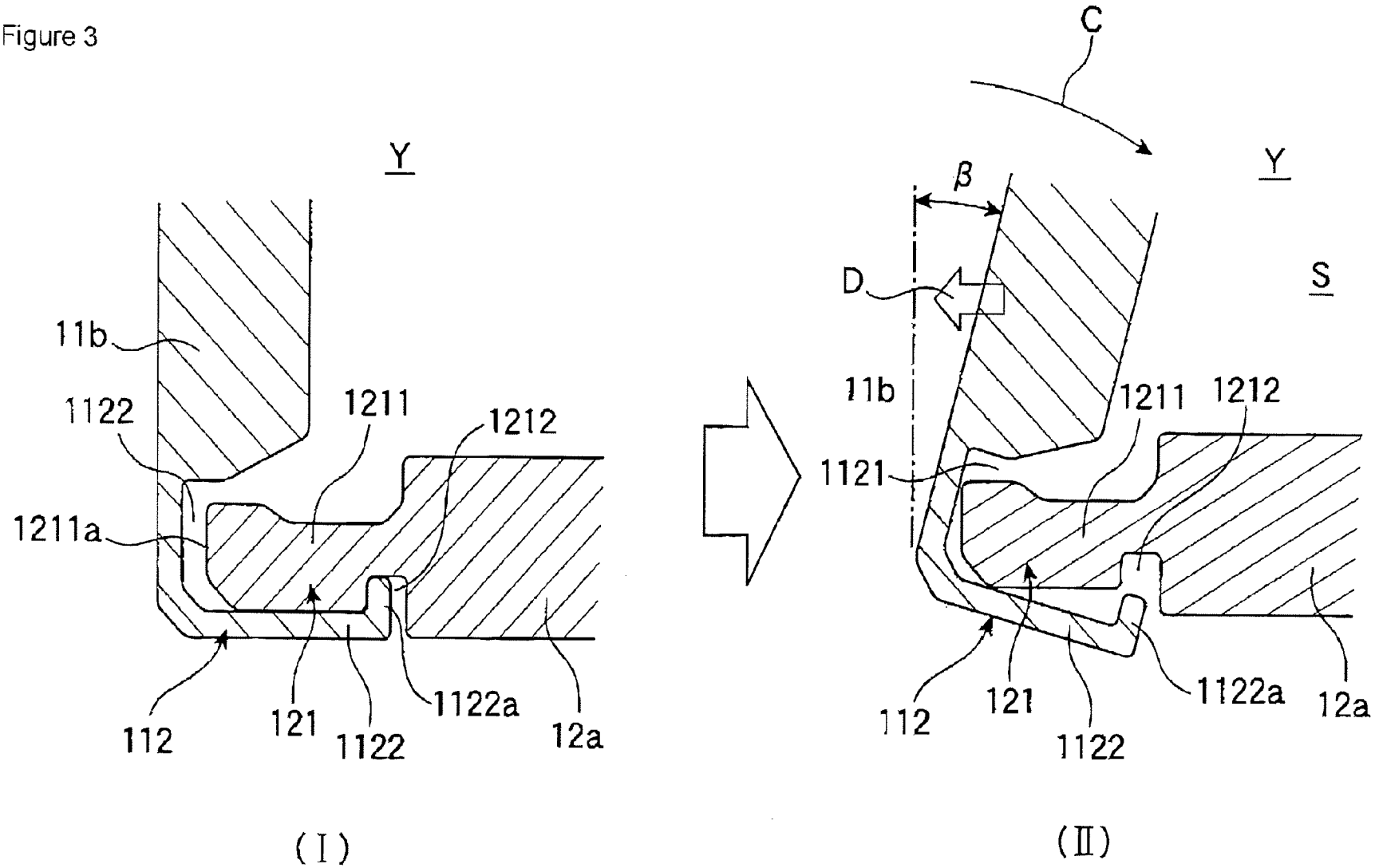
FIG. 3 is a magnified view of a Y portion in FIG. 1 (showing a connecting structure)
Figure 4:
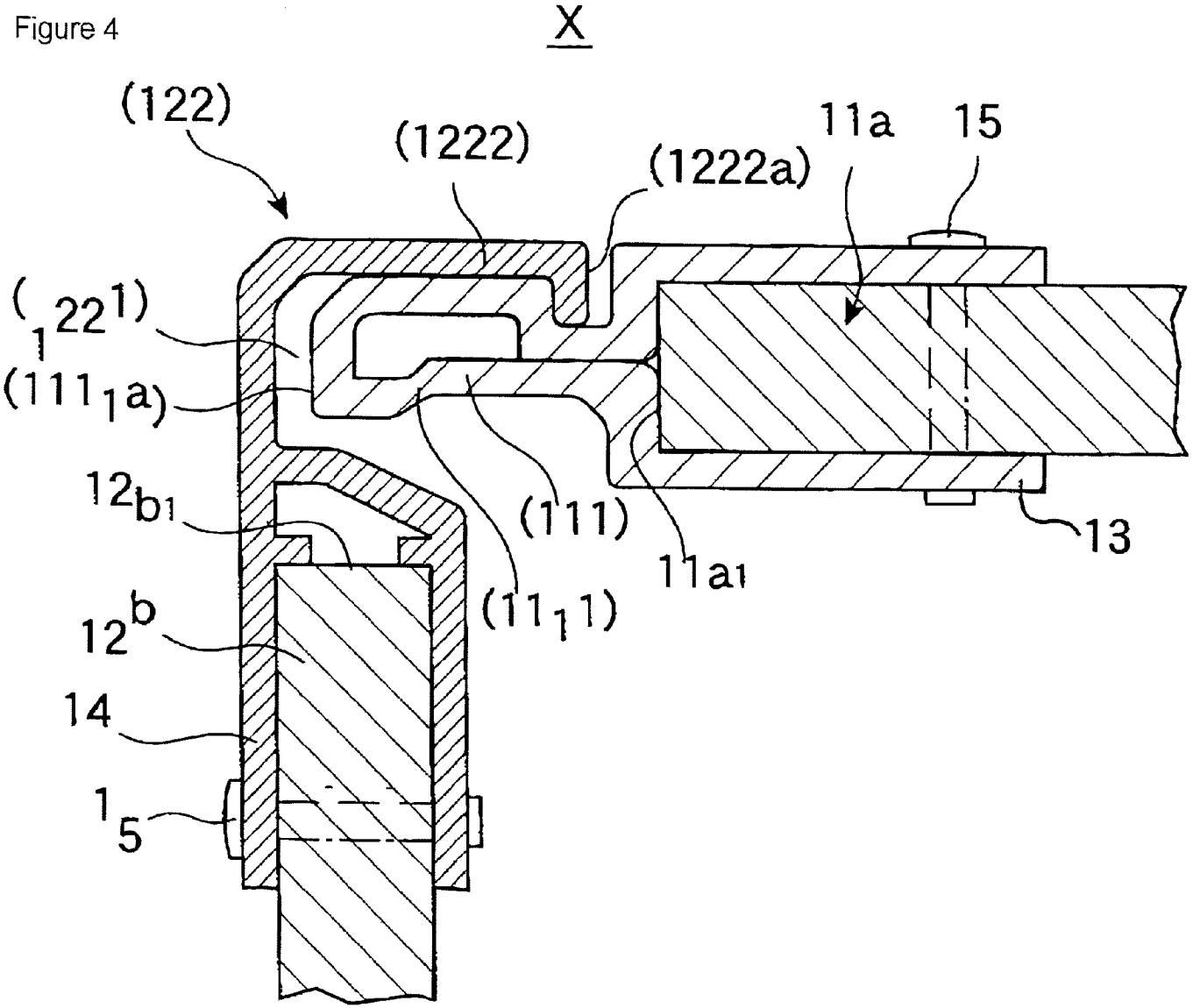
FIG. 4 is a view showing an embodiment using first and second connecting parts formed separately from plate materials.
Figure 5:
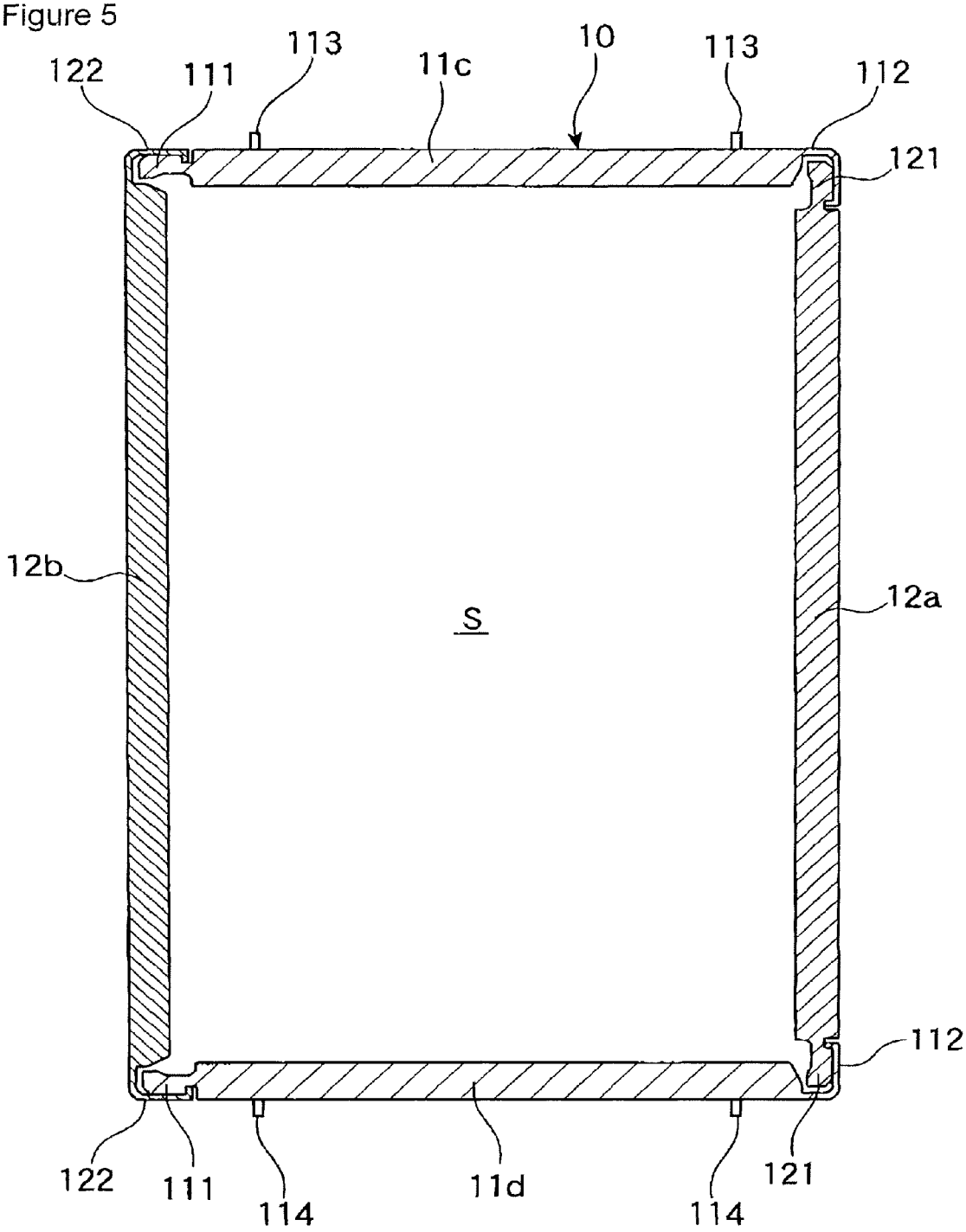
FIG. 5 is a top plan view showing a modified embodiment of the frame.
Figure 6:
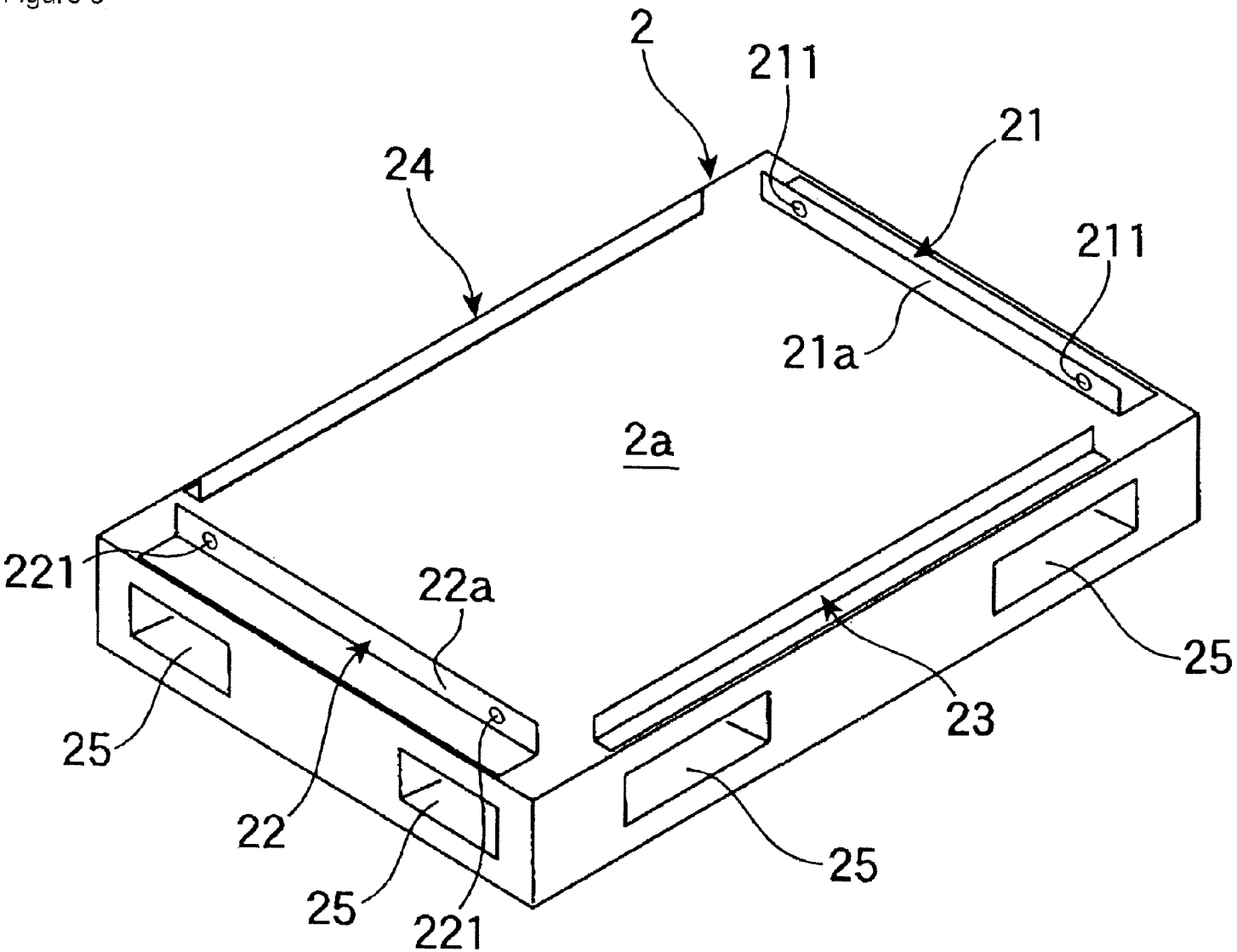
FIG. 6 is a view showing one example of an embodiment of a base (2) for placement of a frame (1 or 10)
Figure 7:
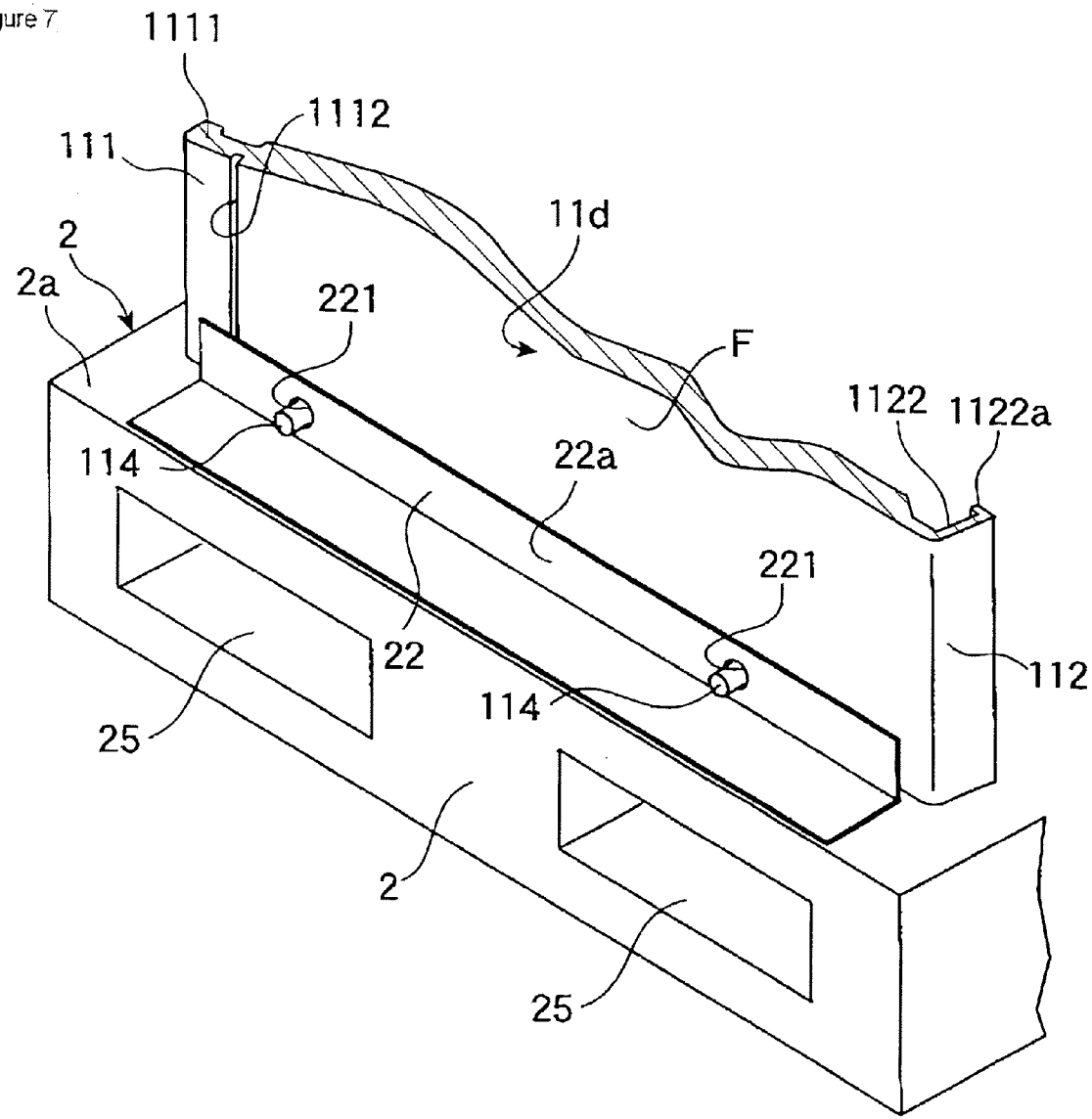
FIG. 7 is a partial perspective view of a guide (22) of a base (2) and its surroundings when one plate material (11*d*) alone is placed inside the guide (22) of the base (2)
Figure 8:
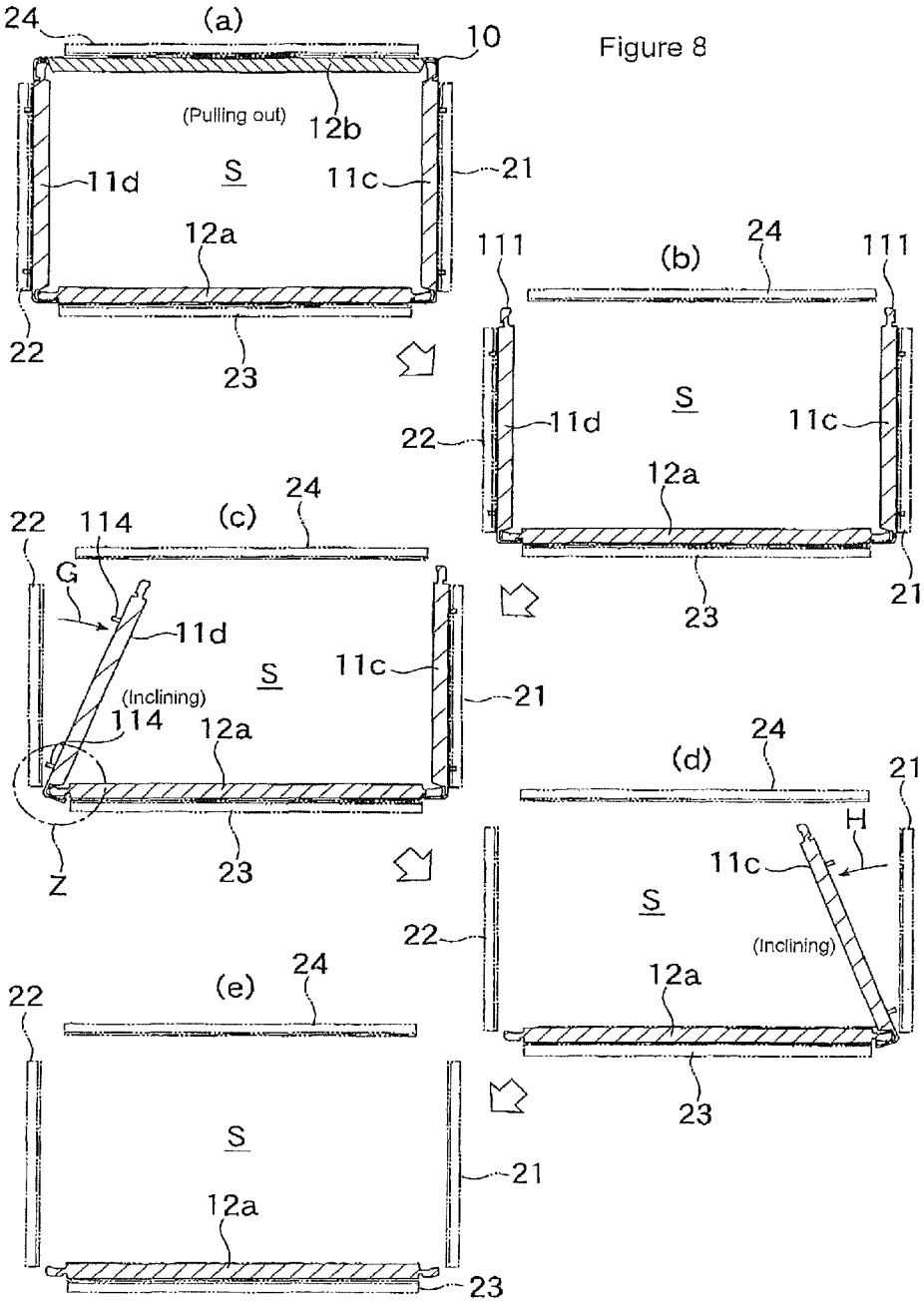
FIG. 8 is a view showing a disassembly process of the frame (10) in five steps (*a* to *e*) with top plan views of the frame (10) on the base (2)
Figure 9:
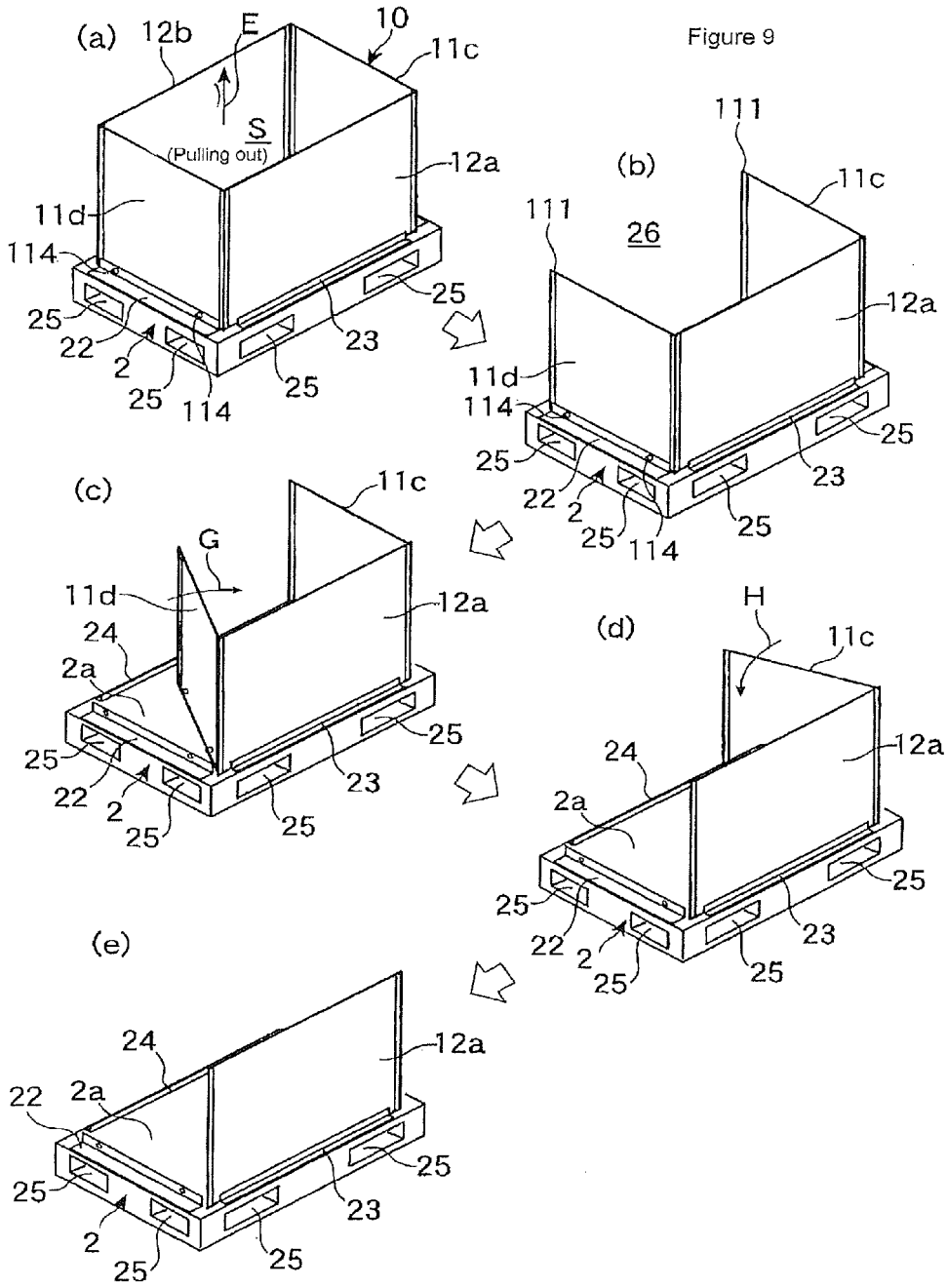
FIG. 9 is a perspective view showing the same disassembly process in five steps (*a* to *e*)
Figure 10:
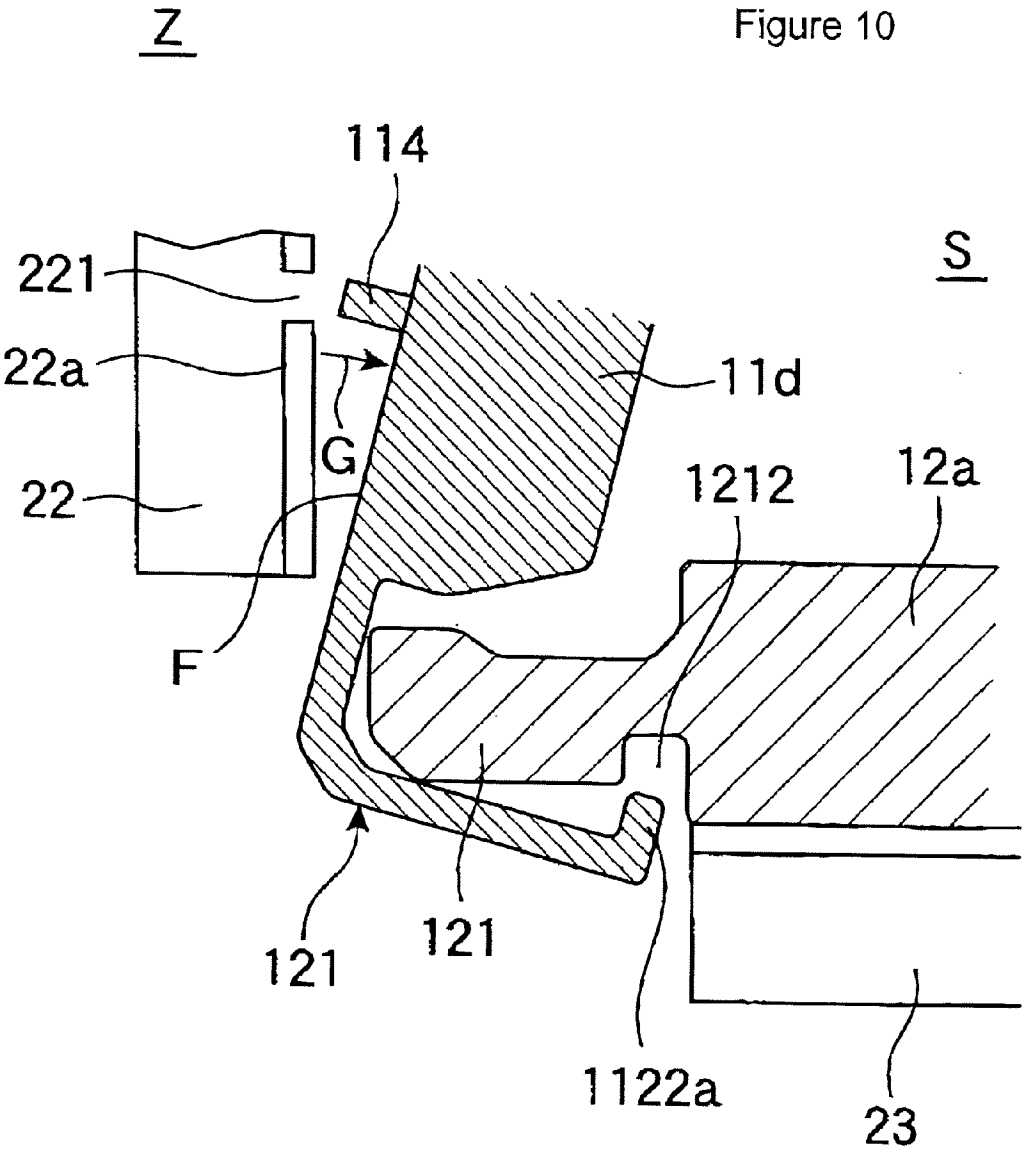
FIG. 10 is a magnified view of a portion indicated with reference code Z in FIG. 8 for illustrating (*c*) step in detail in the disassembly process.
Figure 11:
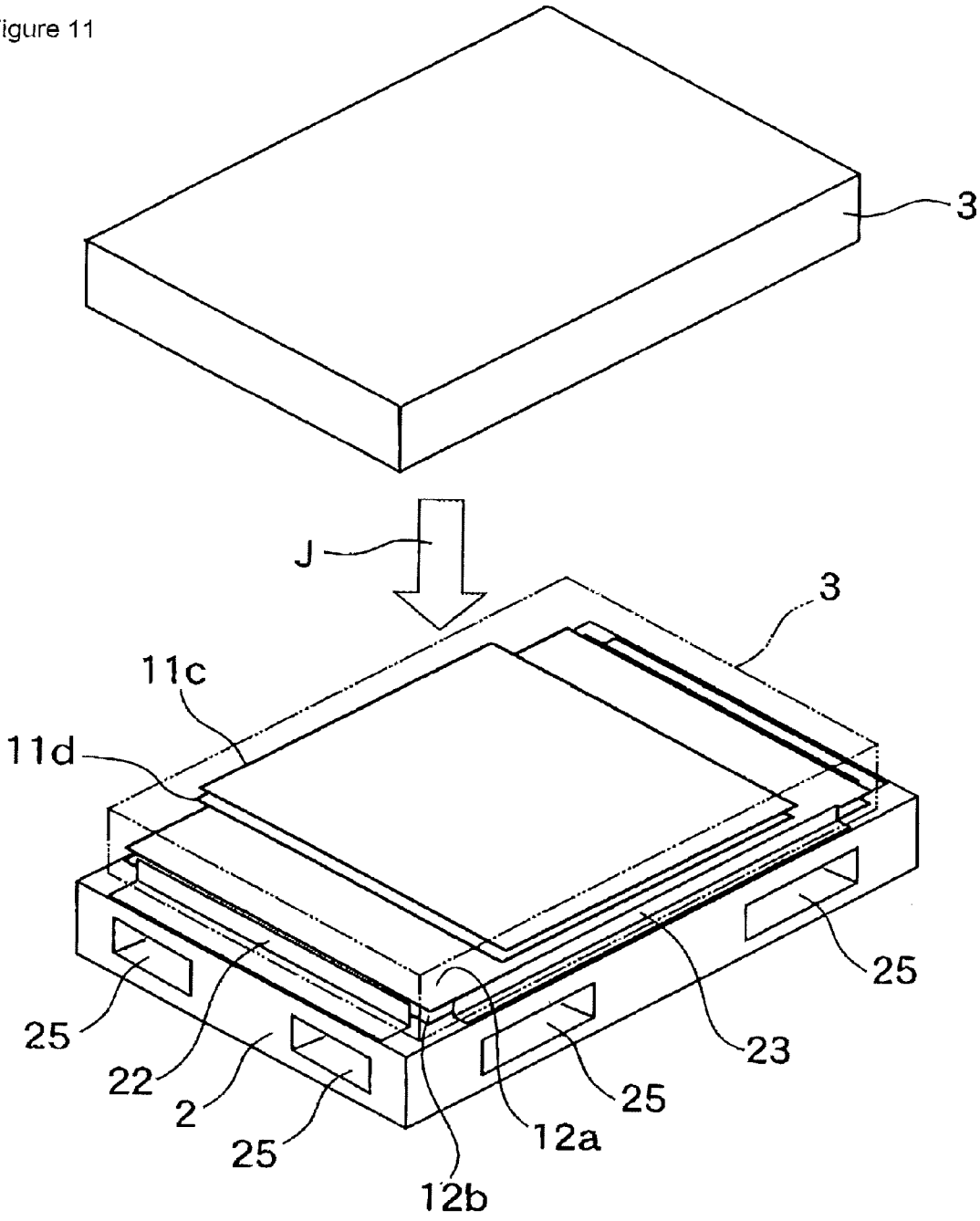
FIG. 11 is a view showing a state where, after all the disassembly steps have been completed, the four separated plate materials (11*c*, 11*d*, 12*a* and 12*b*) are stacked on the placement plane (2*a*) of the base (2) and the cover member (3) is being laid on the placement plane 2*a* from above to cover the placement plane 2*a;*
Figure 12:
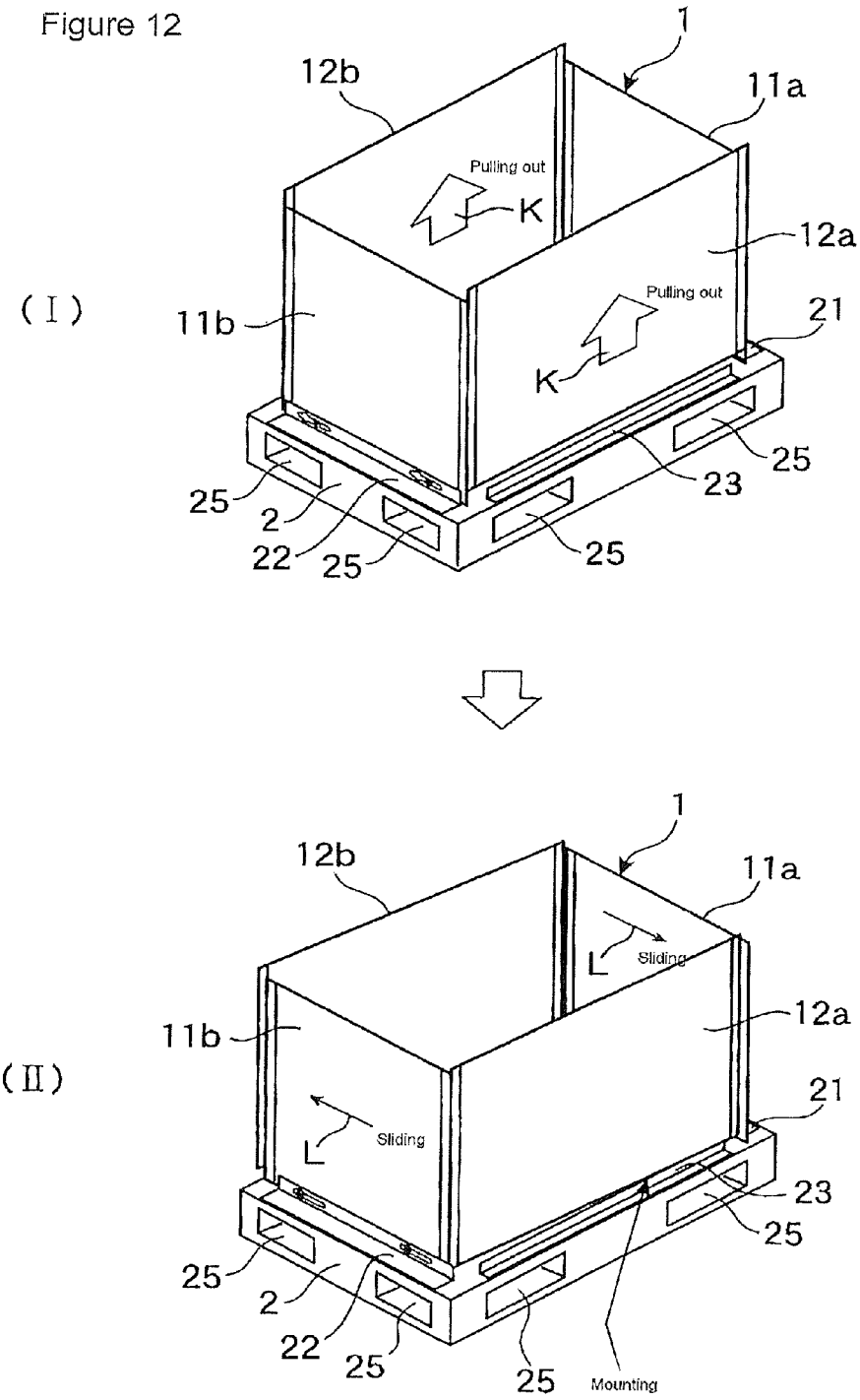
FIG. 12 is a view for illustrating an initial step in a disassembly process of the frame (1)
Figure 13:
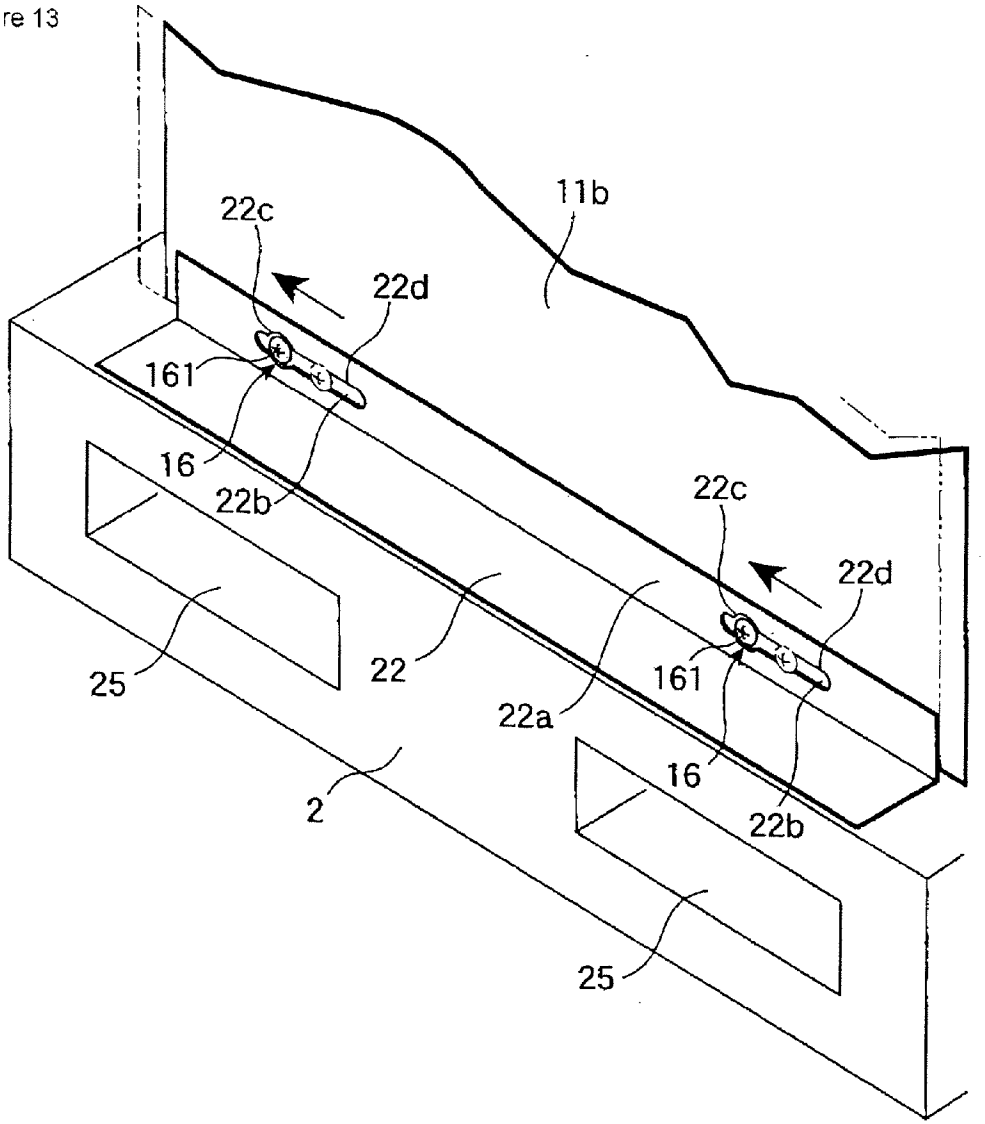
FIG. 13 is a view for illustrating a configuration involved in a sliding operation of the plate material (11*b*) constituting the frame (1)
Figure 14:
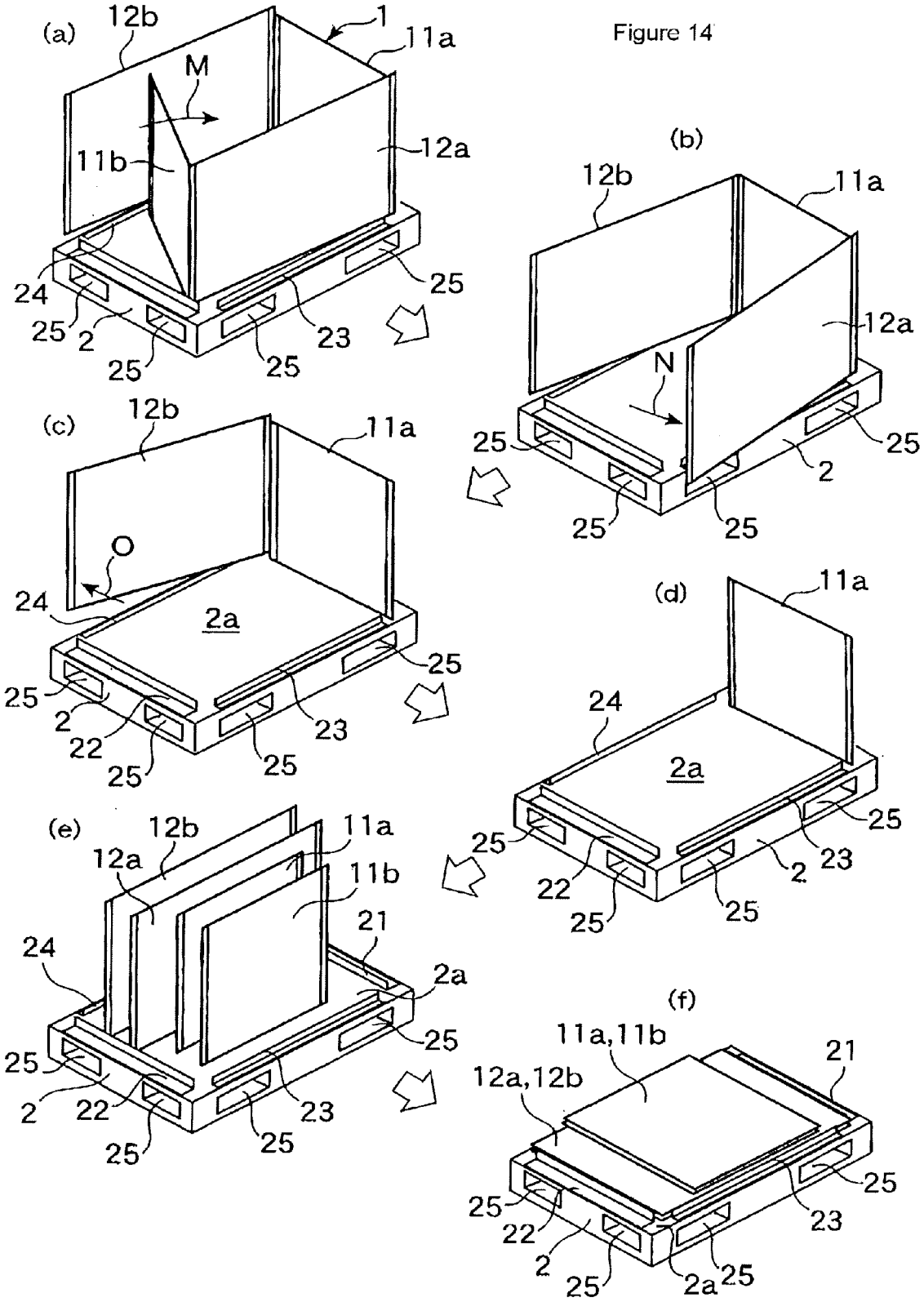
FIG. 14 is a view for illustrating in sequence the steps in the disassembly process of the frame (1).

1 and 10 Frame
2 Base
3 Cover member
11*a*, 11*b*, 11*c* and 11*d* (Transverse) plate material
12*a* and 12*b* (Longitudinal) plate material
111 and 121 First connecting part
112 and 122 Second connecting part
1111 and 1211 Forefront portion (of the first connecting part)
1112 and 1212 Concave groove (of the first connecting part)
1121 and 1221 Space (for embracing the forefront portion 1211 and 1111)
1122 and 1222 L-shaped pawl (of the second connecting part)
α and β Angle required for inclining a plate material

The invention claimed is:

1. An assembly box, comprising:

a frame that is rectangular as seen from a top and whose four sides are formed from four plate materials which are rectangular as seen from a front, and which have bottom ends and side edges;

a base that has a placement plane for the frame and guides for supporting the bottom ends of the plate materials constituting the frame on the placement plane, and plate material connecting parts positioned at corners of the frame, each of which has a detachable locking mechanism, wherein each of the plate material connecting parts includes a first connecting part along the side edge of one plate material; and a second connecting part along the side edge of the other plate material and capable of being locked into the first connecting part, the first connecting part having a forefront portion and a concave groove formed at a position with a predetermined distance from an end of the forefront portion, and the second connecting part including a space capable of embracing the forefront portion and an L-shaped pawl having an end bending portion fitted into the concave groove, the concave groove and L-shaped pawl being structured such that the L-shaped pawl can be withdrawn from the concave groove to disconnect two connected plate materials by inclining either one of the plate materials at a predetermined angle that is less than 90° with respect to the connecting part, and wherein, among said plate materials, at least one plate material has a projection extending from an outer side surface of its bottom end, and at least one another plate material has no projection on an outer surface of its bottom end, such that when the frame is placed on the base, the projection is inserted into a hole formed in one of said guides, and when the frame is disassembled, the plate material having no projection is pulled out first, allowing the plate material having the projection to be inclined inwardly to withdraw the projection from the hole, wherein the projection is an elongated, peg-like member that extends at least substantially through the hole, and the inclination of the plate material having the projection around a vertical axis inwardly after the plate material having no projection is pulled out causes the plate material having the projection to disconnect from both other plate materials and the guide by withdrawal of the projection from the hole and withdrawal of the end bending portion from the concave groove.

2. The assembly box according to claim 1, wherein the predetermined angle is 5° or more.

3. The assembly box according to claim 1, wherein disassembled plate materials are stacked on the placement plane of the base and are closed by a cover member capable of being fixed to the base.

4. The assembly box according to claim 1, wherein the assembly box is a container or case for transporting an article.

5. The assembly box according to claim 1, wherein among said four plate materials, two plate materials have the projection, and the other two plate materials have no projection.

6. The assembly box according to claim 1, wherein among said four plate materials, the one plate material having no projection has the second connection part at both ends.

* * * * *